US008136496B2

(12) United States Patent
Wolck

(10) Patent No.: US 8,136,496 B2
(45) Date of Patent: Mar. 20, 2012

(54) VALVE ROTATOR ASSEMBLY

(75) Inventor: John G. Wolck, Pewaukee, WI (US)

(73) Assignee: Helio Precision Products, Inc., Lake Bluff, IL (US)

( * ) Notice: Subject to any disclaimer, the term of this patent is extended or adjusted under 35 U.S.C. 154(b) by 523 days.

(21) Appl. No.: 12/362,379

(22) Filed: Jan. 29, 2009

(65) Prior Publication Data

US 2010/0186690 A1 Jul. 29, 2010

(51) Int. Cl.
*F01L 3/10* (2006.01)

(52) U.S. Cl. ..... 123/90.65; 123/90.66; 123/90.67

(58) Field of Classification Search ..... 123/90.65, 123/90.66, 90.67

See application file for complete search history.

(56) References Cited

U.S. PATENT DOCUMENTS

| | | | |
|---|---|---|---|
| 2,819,706 | A | 1/1958 | Gammon |
| 2,848,985 | A | 8/1958 | Norton |
| 3,421,734 | A | 1/1969 | Updike et al. |
| 3,537,325 | A | 11/1970 | Orent |
| 3,554,562 | A | 1/1971 | Davis, Jr. |
| 3,890,943 | A | 6/1975 | Schonlau et al. |
| 4,175,505 | A | 11/1979 | Shimada et al. |
| 4,241,706 | A | 12/1980 | Shimada et al. |
| 4,333,026 | A | 6/1982 | Bock et al. |
| 4,425,882 | A | 1/1984 | Updike et al. |
| 4,538,558 | A | 9/1985 | Updike et al. |
| 5,148,779 | A | 9/1992 | Okuse et al. |
| 5,570,663 | A | 11/1996 | Shida |
| 7,059,340 | B2 | 6/2006 | Hecking |
| 7,622,196 | B2 * | 11/2009 | Wilson ..... 428/469 |

OTHER PUBLICATIONS

International Search Report and Written Opinion of the International Searching Authority, International Patent Application No. PCT/US10/21330, mailed Apr. 1, 2010.

* cited by examiner

*Primary Examiner* — Ching Chang

(74) *Attorney, Agent, or Firm* — Michael Best & Friedrich LLP

(57) ABSTRACT

A valve rotator for use in an internal combustion engine. The valve rotator including a plurality of retention members, each able to removeably and rotateably couple the stationary housing to the rotating body. The plurality of retention members are defined by a plurality of recesses allowing each of the plurality of retention members to deflect with respect to the stationary housing. The retention members allow the rotating body to be removed from the stationary housing without the need for permanently damaging the stationary housing (e.g. during rebuilding). Additionally, the retention members may be incorporated on housings that have undergone heat treatment processes without rendering the housings susceptible to cracking or damage.

14 Claims, 12 Drawing Sheets

VALVE ROTATOR ASSEMBLY

FIELD OF THE INVENTION

The present invention relates to valve rotators for internal combustion engines, and more specifically to valve rotators with snap fit housings.

BACKGROUND

During operation, the cylinders of large internal combustion engines often create a heat gradient from the relatively cool intake side of the cylinder and the relatively hot exhaust side of the cylinder. This heat gradient may cause warping of the intake and exhaust valves if the gradient becomes too intense, thereby accelerating wear and potentially damaging the valves and valve seats. To combat these effects, valve rotators are commonly installed to rotate the valves during engine operation, which results in the valves being subjected to a more even distribution of heat. Rotation of the valve also provides a more even wear pattern for the valve and valve seat.

Valve rotators are frequently constructed in two parts, a housing that engages and is fixed relative to an end of the valve spring(s), and a body coupled to the valve stem. For every reciprocating movement of the valve, the body and the valve together rotate a small amount relative to the housing.

For higher performance and enhanced durability, valve springs are becoming increasingly hard and stiff. In response, the housing of the valve rotator assembly must also be hardened to resist premature wear on the surfaces of the housing that contact the spring. As a result of this hardening, the housing also becomes increasingly brittle and prone to cracking when worked. This issue is particularly troublesome in valve rotator assemblies in which an edge surface of the housing is cold rolled over a portion of the rotator body to form a locking bead that secures the two components together. Many times, the addition of the locking bead to a hardened housing by cold forming results in the part being cracked and/or rendered unusable.

SUMMARY

In some embodiments, the invention provides a valve rotator assembly for rotating an internal combustion engine valve about an axis in response to reciprocating movement of the valve. The assembly includes a body for coupling to a portion of the valve and including a retention surface. The assembly also includes a housing that removably and rotatably receives the body. The housing includes a bottom wall and a plurality of resilient members that engage the retention surface to removably couple the body to the housing. The assembly also includes a rotary advance mechanism that engages the body and the housing to rotate the body relative to the housing.

In some embodiments, the invention provides a method of assembling a valve rotator for rotating a valve of an internal combustion engine about an axis. The method includes providing a housing including a plurality of resilient members and a body for coupling with the valve and including a retention surface. Components of a rotary advance mechanism are positioned between the housing and the body, and the body is positioned for insertion into the housing. The body is axially inserted into the housing, which includes engaging the body with the resilient members to thereby urge the resilient members away from a relaxed position. The retention surface is moved axially beyond the resilient members, which allows the resilient members to return to the relaxed position so as to retain the body within the housing.

DETAILED DESCRIPTION

Figure 1:
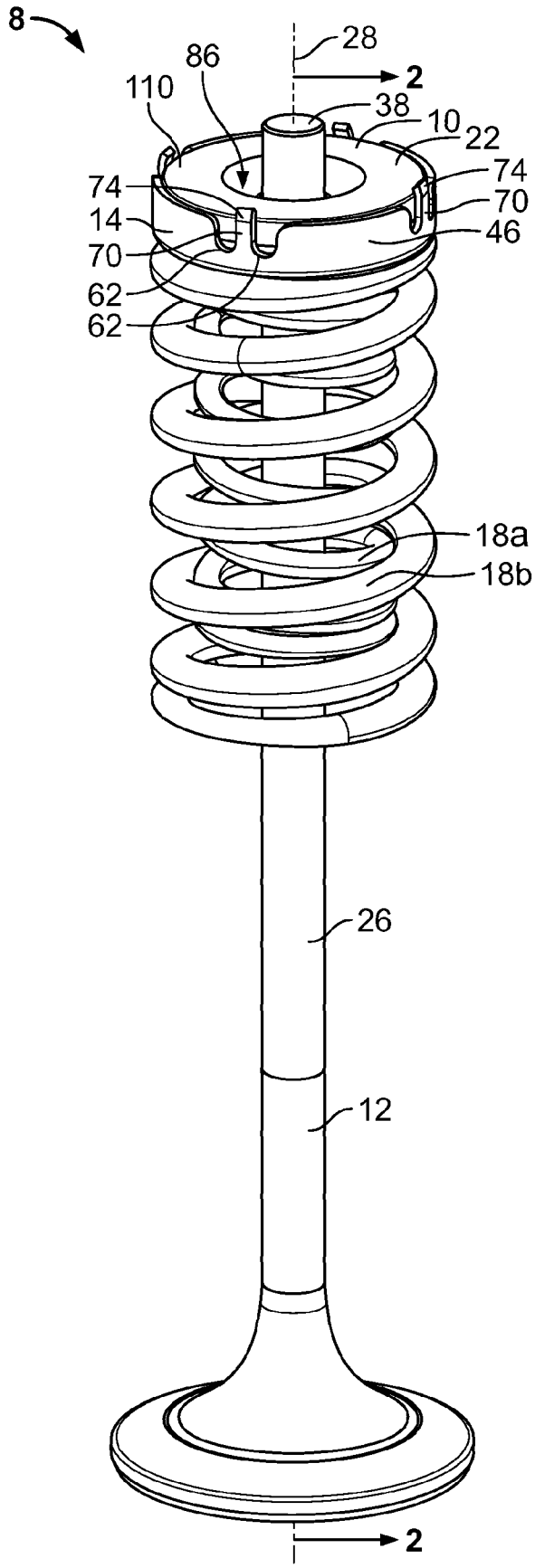
FIG. 1 is a perspective view of a valve assembly for an internal combustion engine.
Figure 2:
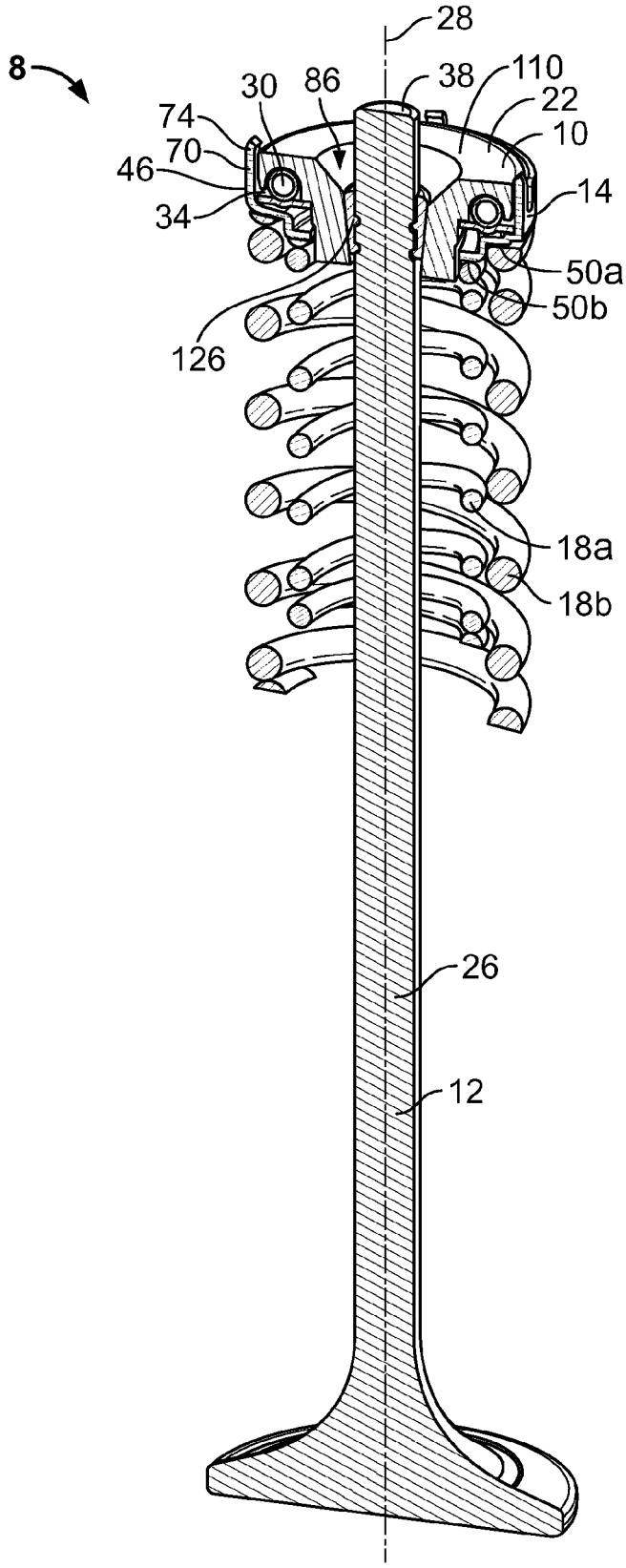
FIG. 2 is a section view taken along line 2-2 of FIG. 1.
Figure 3:
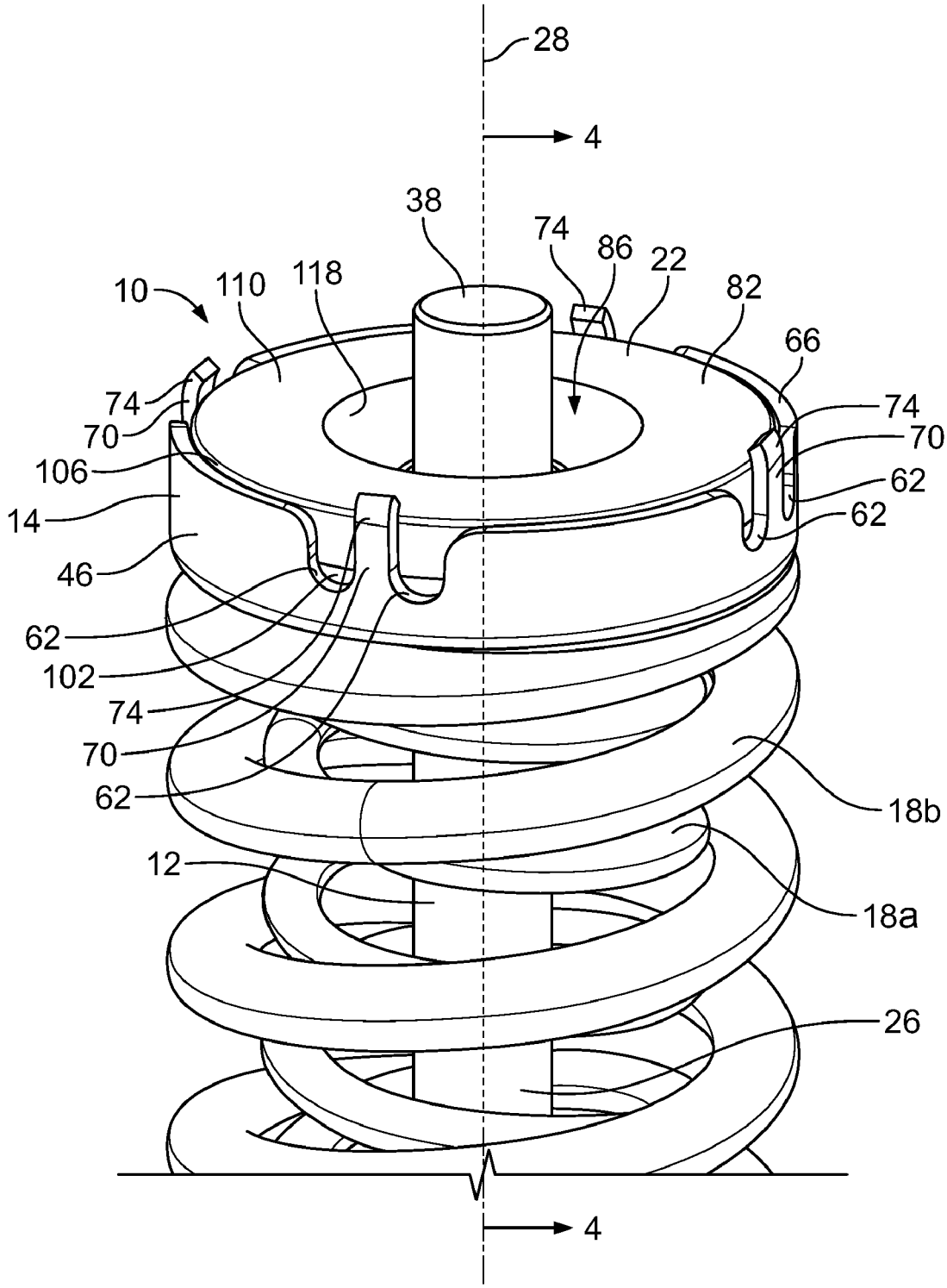
FIG. 3 is an enlarged perspective view of the valve assembly of FIG. 1.
Figure 4:
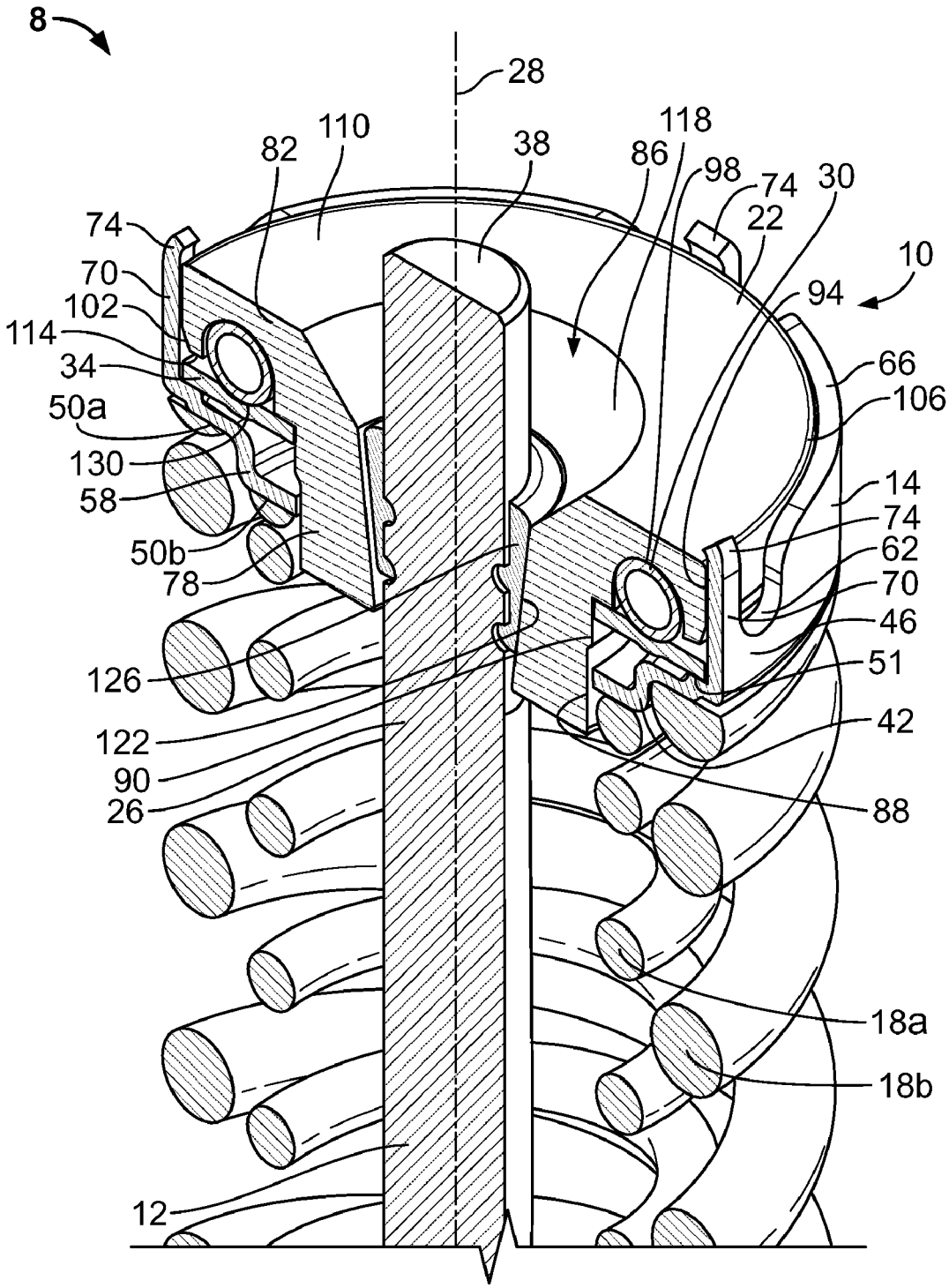
FIG. 4 is a section view taken along line 4-4 of FIG. 3.
Figure 5:
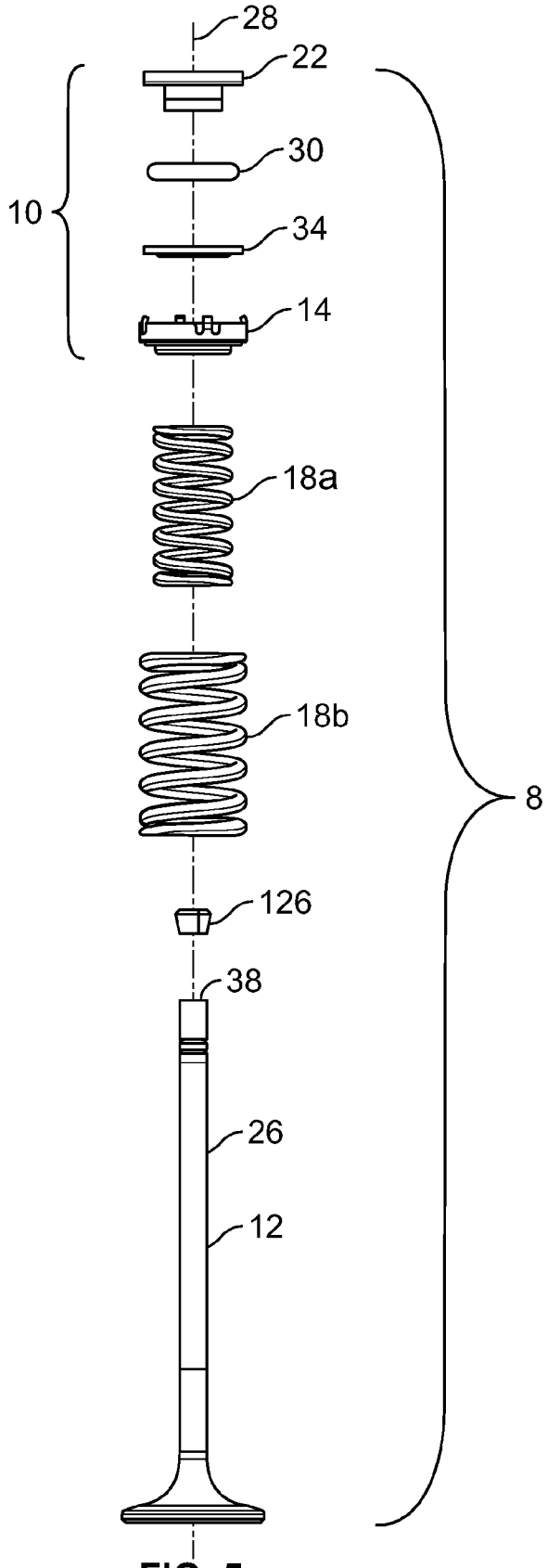
FIG. 5 is an exploded view of the valve assembly of FIG. 1.
Figure 6:
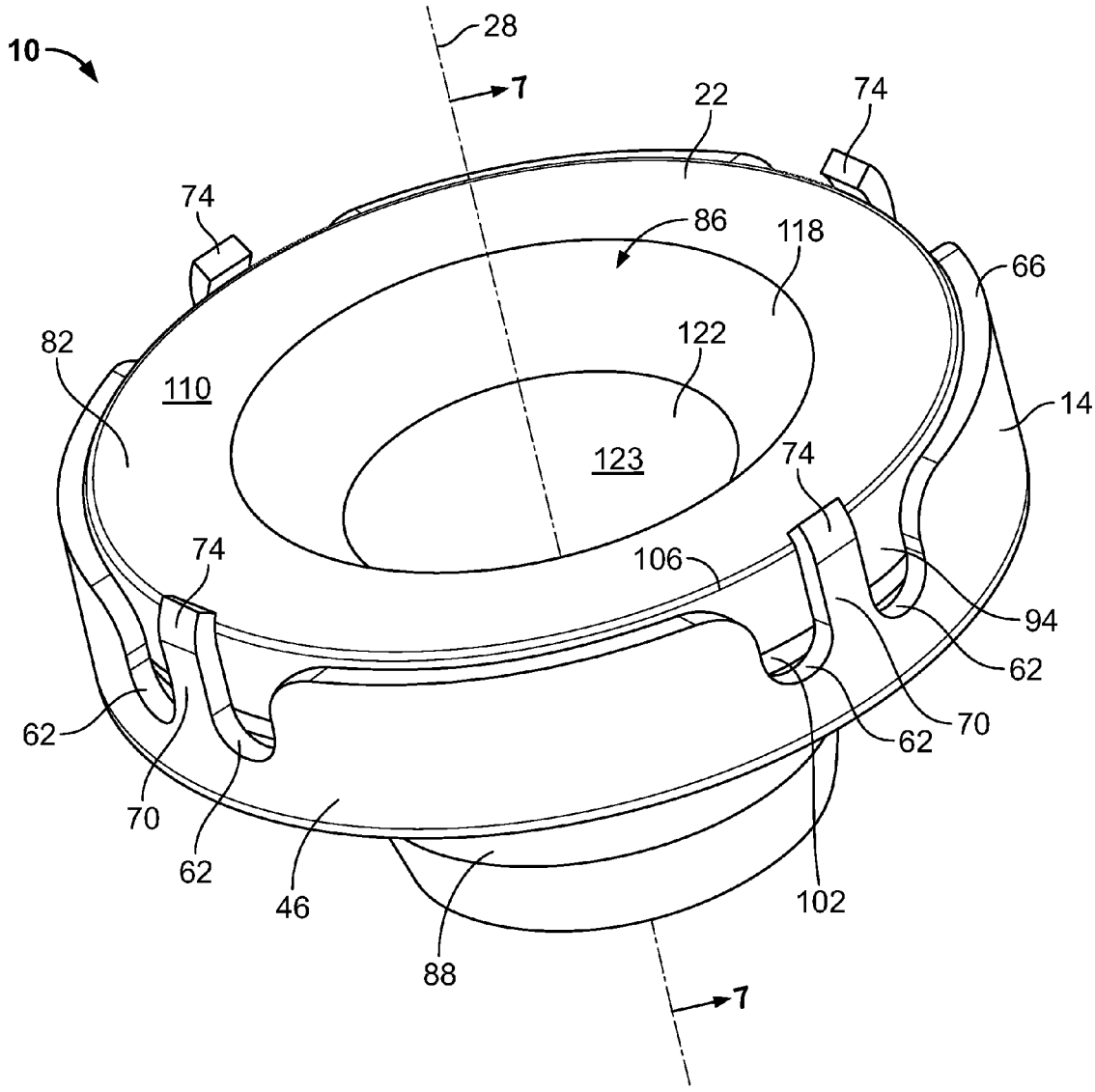
FIG. 6 is a perspective view of a valve rotator assembly of the valve assembly of FIG. 1.
Figure 7:
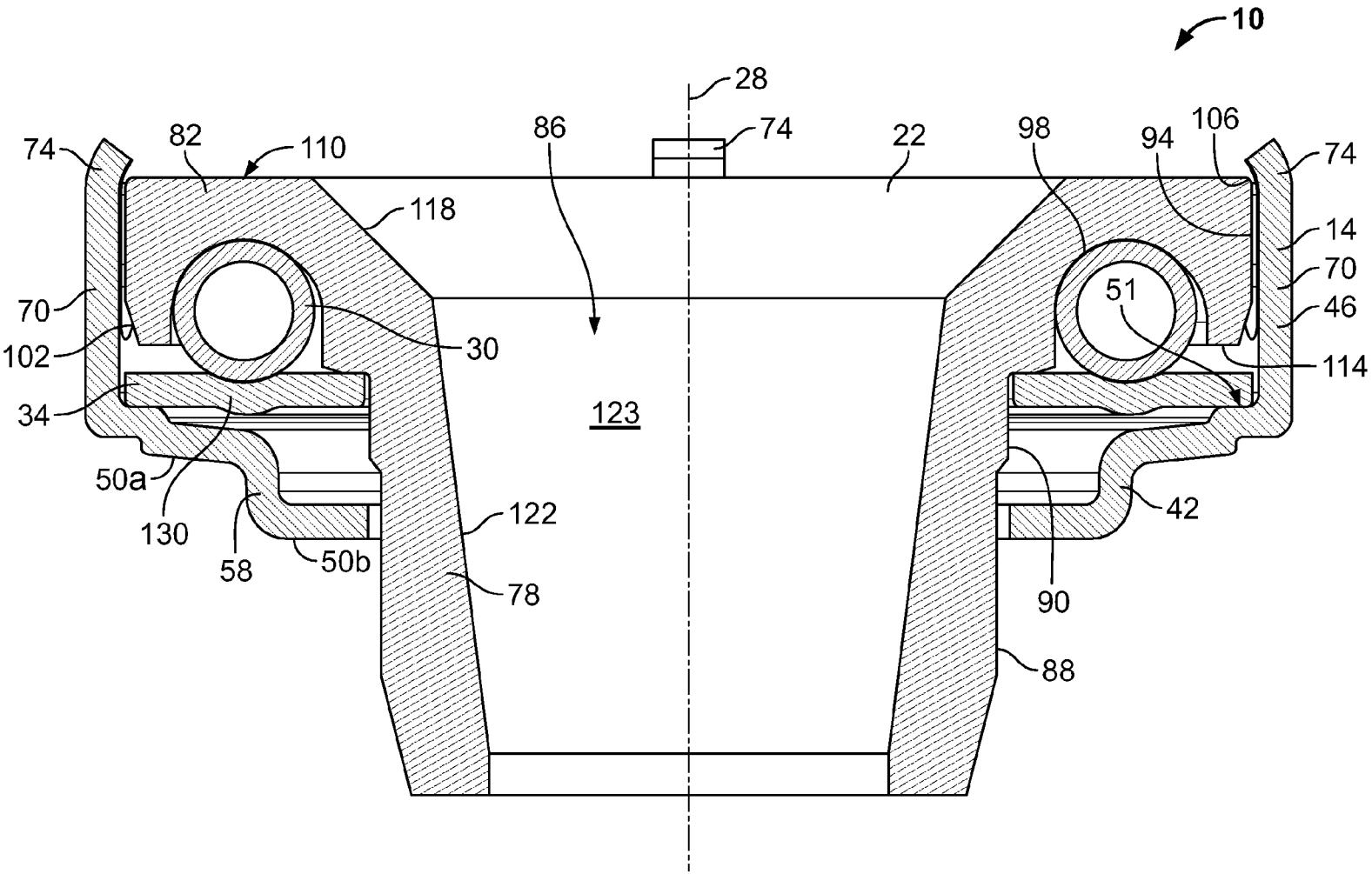
FIG. 7 is a section view taken along line 7-7 of FIG. 6.
Figure 8:
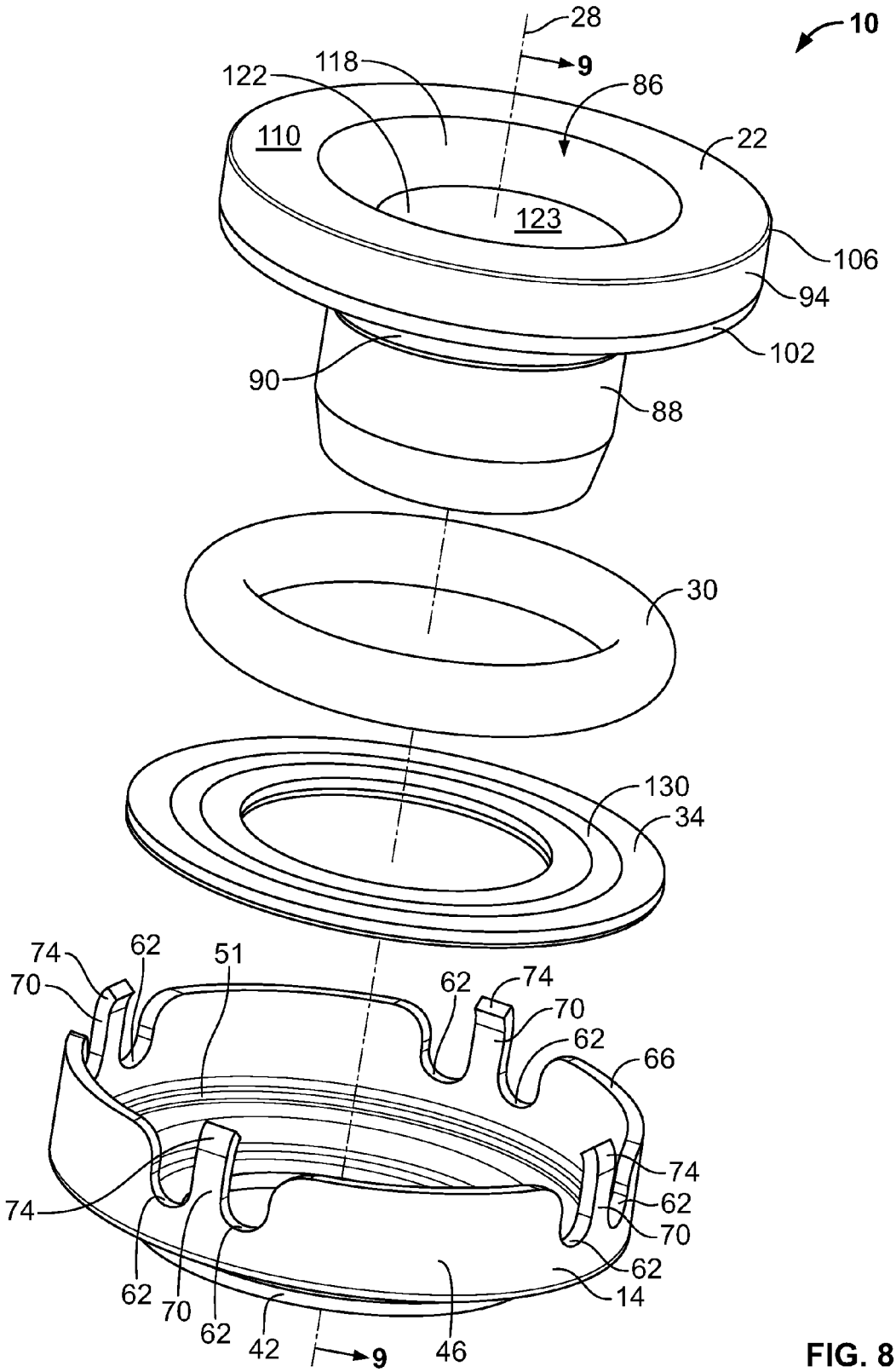
FIG. 8 is an exploded view of the valve rotator assembly of FIG. 6.
Figure 9:
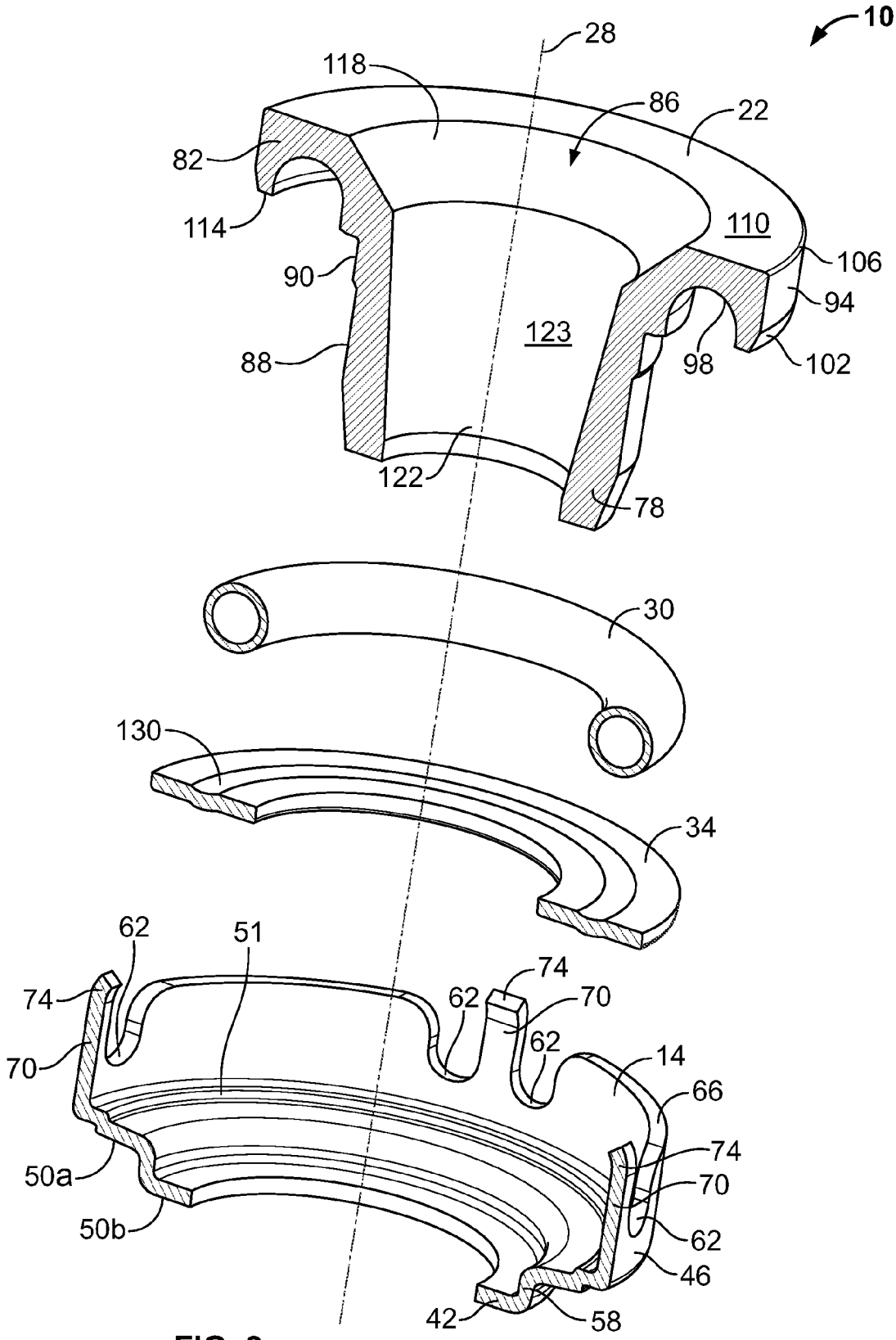
FIG. 9 is a section view taken along line 9-9 of FIG. 8.
Figure 10:
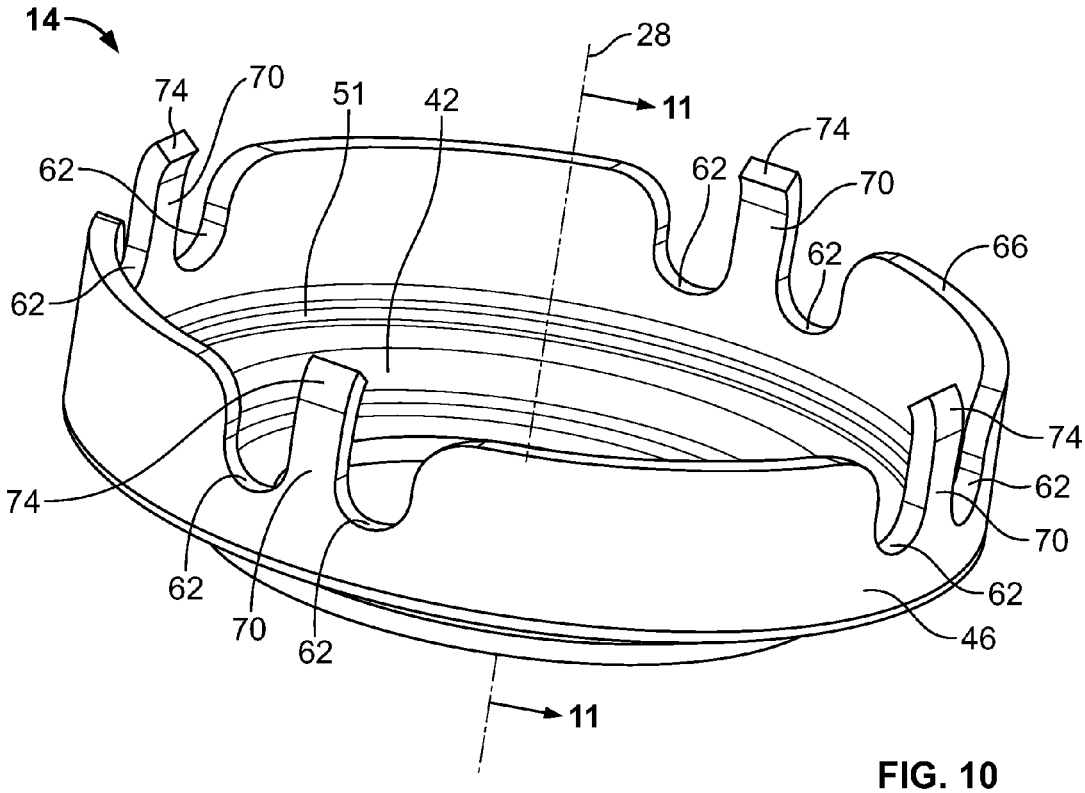
FIG. 10 is a perspective view of a rotator housing of the valve rotator assembly of FIG. 6.
Figure 11:
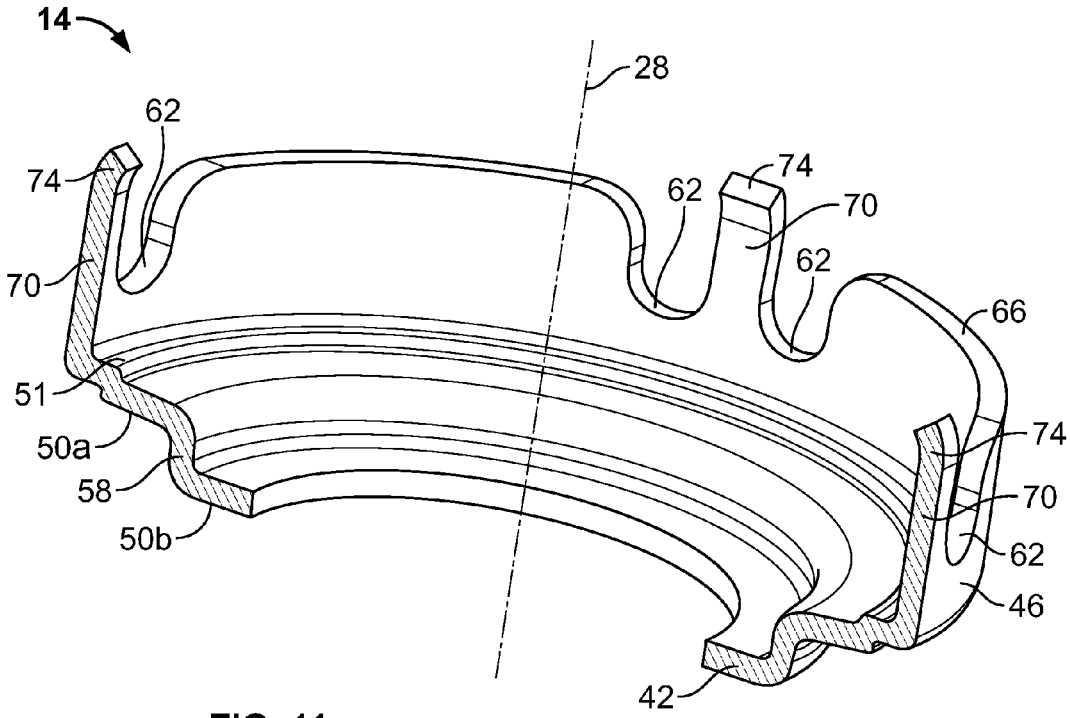
FIG. 11 is a section view taken along line 11-11 of FIG. 10.

It is to be understood that the invention is not limited in its application to the details of construction and the arrangements of the components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

FIGS. 1-5 illustrate a valve assembly 8 for use in an internal combustion engine. The valve assembly 8 includes a valve rotator assembly 10 that supports a valve 12. The valve rotator assembly 10 includes a rotator housing 14 that engages the end(s) of one or more valve springs 18*a*, 18*b*, and a rotator body 22 received by and fitting generally within the rotator housing 14. The rotator body 22 receives and engages a stem portion 26 of the valve 12 that generally defines a valve axis 28. The rotator assembly 10 also includes a helical garter spring 30 that extends around and is received by an annular recess 98 defined by the rotator body 22. The garter spring 30 also engages a spring washer 34 that fits between the garter spring 30 and an inner surface 51 of the housing 14. The garter spring 30 and spring washer 34 together define a rotary advance mechanism that rotates the body 22 relative to the housing 14. During engine operation, a valve actuation component (e.g., a cam lobe and/or a rocker arm, not shown) directly or indirectly applies a force to an upper surface 38 of the valve stem 26 to open the valve 12 (opening movement of the valve is in a generally downward direction with respect to FIGS. 1-4). The valve spring(s) 18*a*, 18*b* resist opening movement of the valve, thereby compressing the spring washer 34 and the garter spring 30 between the rotator housing 14 and the rotator body 22. As the valve 12 returns to the closed position, the compressive forces between the valve spring(s) 18*a*, 18*b* and the valve actuation component reduce. Actuation of the valve 12 in this manner causes the spring washer 34 and the garter spring 30 to cyclically compress and expand, which in turn causes the rotator body 22 and the valve 12 to rotate with respect to the rotator housing 14 in a known manner.

With reference also to FIGS. 6-11, the rotator housing 14 includes a bottom wall 42 that engages the valve spring(s) 18*a*, 18*b*, and an outer wall 46 extending around an outer circumference of the bottom wall 42 and generally perpendicularly away from the bottom wall 42. The bottom wall 42 extends generally radially inwardly from the outer wall 46 and includes one or more spring seats 50*a*, 50*b*. Each spring seat 50*a*, 50*b* is shaped to retain a corresponding one of the valve springs 18*a*, 18*b*. In the illustrated construction, the spring seats 50*a*, 50*b* form concentric annular surfaces, with each annular surface sized to substantially correspond to the diameter of the valve spring 18*a*, 18*b* it retains. The spring seats 50*a*, 50*b* may also be formed on axially offset yet generally parallel planes to provide one or more retaining walls 58. The retaining wall(s) 58 may be sized and shaped to provide radial stability to the valve springs 18*a*, 18*b*, and to help properly locate the valve rotator assembly 10 relative to the valve springs 18*a*, 18*b* during assembly. In alternate constructions, the one or more spring seats 50*a*, 50*b* may be formed in a common plane and/or be formed as or by a recess in the rotator housing 14. In still further constructions, there may only be a single engagement surface for the one or more valve springs 18*a*, 18*b*. In yet another construction, the innermost valve seat 50*b* may be provided with an additional retaining wall corresponding to the inner diameter of the inner valve spring 18*b*.

The outer wall 46 defines a plurality of generally U-shaped recesses 62 that open at an upper edge 66 of the outer wall 46 and extend generally downwardly therefrom toward the bottom wall 42. In the illustrated embodiment, the edges of the wall that define each recess 62 are filleted and/or radiused to reduce stresses along the outer wall 46 in the vicinity of the recesses 62.

The outer wall 46 includes a plurality of resilient retention members 70 (e.g., 4 in the illustrated construction) that extend substantially perpendicularly away from the bottom wall 42 between adjacent ones of the recesses 62. The retention members 70 are configured to be radially deflectable relative to the remainder of the outer wall 46, away from a relaxed position, during assembly and disassembly of the valve rotator assembly 10. The retention members 70 are generally equally distributed about the circumference of the outer wall 46. In the illustrated construction, each retention member 70 includes a distal end that extends beyond the upper edge 66 of the remainder of the outer wall 46. The distal end extends radially inwardly relative to the remainder of the retention member 70 to form a retaining tip 74. In alternate constructions the retaining tip 74 may be formed as a hook, or may include a distal end having a first, proximal portion that extends radially inwardly, and a second distal portion that extends radially outwardly. The retention members 70 and retaining tips 74 may include other forms and configurations that allow the rotator housing 14 to removeably and rotatably receive the rotator body 22, as discussed below.

In the illustrated embodiment, the rotator housing 14 is generally formed from sheet material by one or more stamping and/or drawing operations; however, alternate constructions may include the rotator housing 14 being forged, cast, machined, or various combinations of these to produce the desired shape. Additionally, the rotator housing 14 is generally formed from a metal (e.g. steel) and is preferably heat treated, induction hardened, case hardened, shot peened or otherwise materially treated to enhance the wear characteristics of the rotator housing 14. In certain embodiments, the rotator housing 14 is formed of a low carbon (0.05-0.15% carbon) or a mild carbon (0.16-0.29% carbon) steel. Two specific examples of suitable carbon steels are AISI 1008 and AISI 1010, which are malleable enough to stamp but include sufficient carbon content for controlled hardening after forming. Although the final surface hardness of the rotator housing 14 depends upon the specific material used and whether and to what extent the rotator housing 14 is hardened, some non-hardened embodiments of the rotator housing 14 include a surface hardness of at least about 107 HK (Knoop hardness). Other embodiments of the rotator housing 14, which are generally hardened in some manner, include a surface hardness of at least about 402 HK, while still other embodiments of the rotator housing 14 include a surface hardness of at least about 510 HK. Furthermore, some embodiments of the rotator housing, also generally hardened, include a surface hardness up to about 776 HK, while other embodiments of the rotator housing 14 are hardened to include a surface hardness up to about 630 HK, and other embodiments of the rotator housing 14 are hardened to include a surface hardness up to about 576 HK. Still other embodiments of the rotator housing 14, which are also generally hardened, include a surface hardness in the range of about 402 HK to about 776 HK, while other embodiments of the rotator housing 14 include a surface hardness in a range of about 510 HK to about 630 HK. One preferred embodiment of the rotator housing 14 is hardened to include a surface hardness in a range of about 510 HK to about 576 HK.

The retention members 70 are configured to deflect radially outwardly as the rotator body 22 is inserted into or withdrawn from the rotator housing 14. When the rotator body 22 is fully received within the rotator housing 14, the retention members 70 return to their original positions, and do not restrict relative rotation between the rotator body 22 and the rotator housing 14. Similarly, when the rotator body 22 is fully withdrawn from the rotator housing 14, the retention members 70 return to their original positions such that the rotator housing 14 may be reused with a different (e.g., a new or rebuilt) rotator body 22 and/or a new or replacement garter spring 30 and spring washer 34.

While the illustrated retention member is substantially uniform in cross section and has a length nearly equal to the height of the outer wall 42, alternate constructions may include a retention member 70 that extends axially and inwardly directly from the upper edge 66 of the outer wall 42. In still other constructions, the retention member 70 may extend only partially toward the upper edge 66 of the outer wall 42. Alternate constructions may further include retention members 70 differing in width and or cross section along their length.

Figure 12:
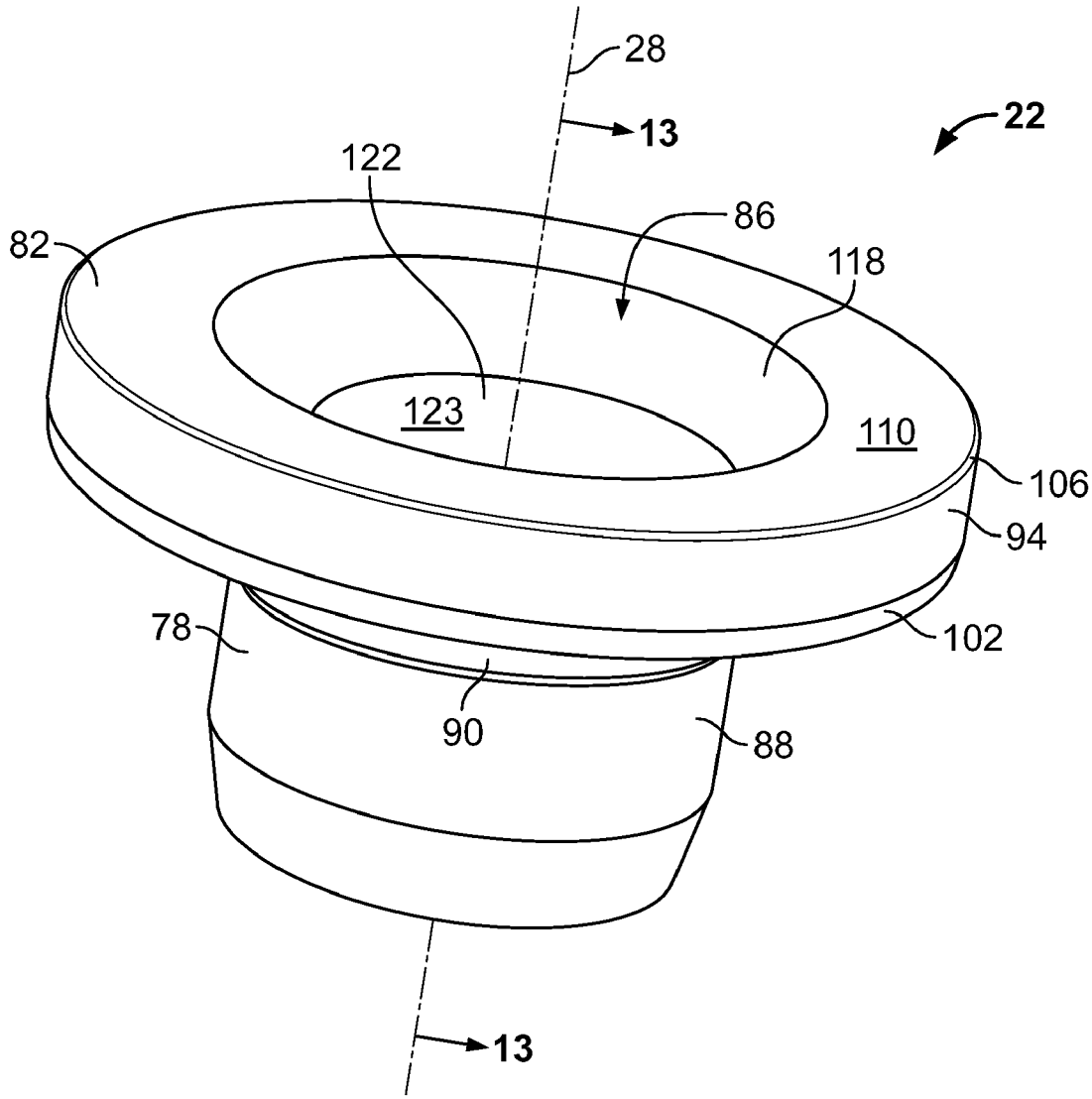
FIG. 12 is a perspective view of a rotator body of the valve rotator assembly of FIG. 6.
Figure 13:
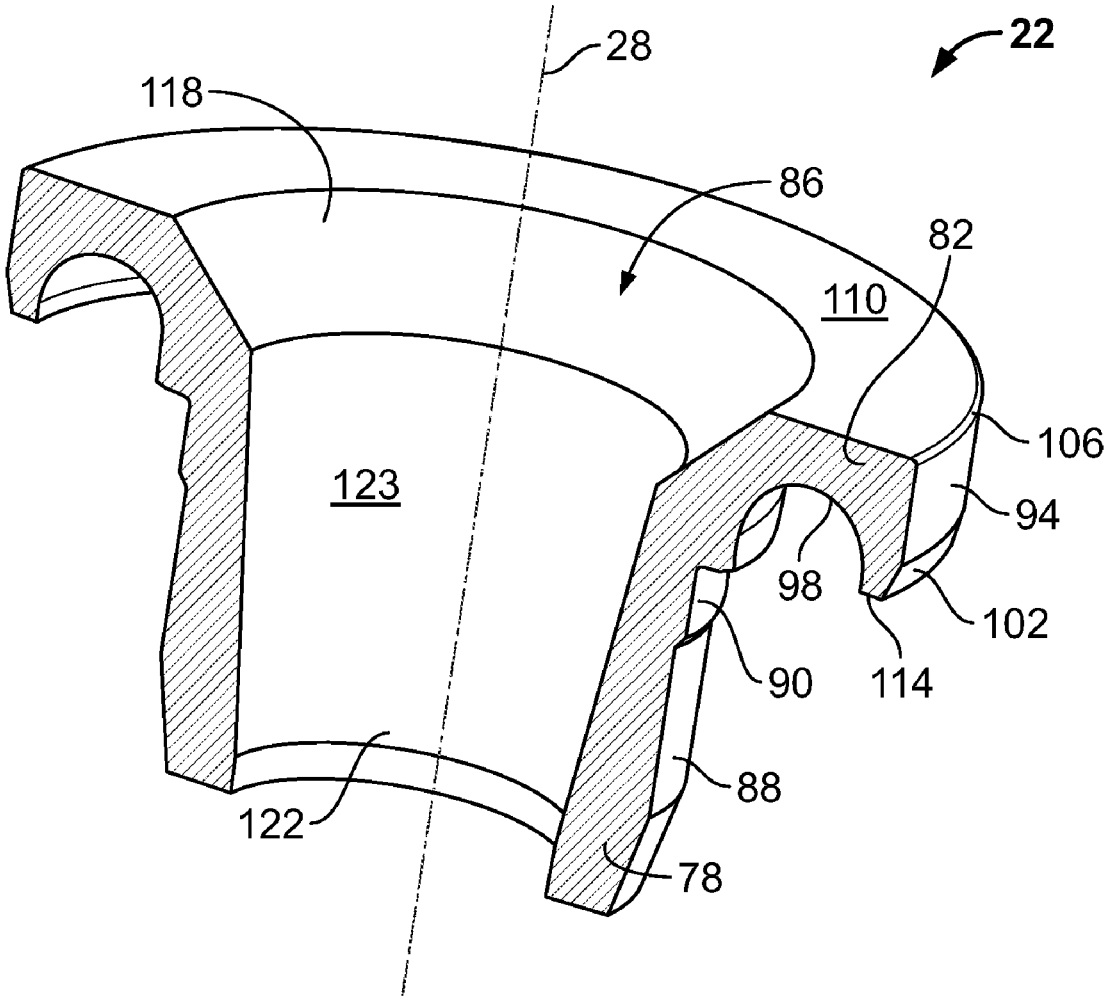
FIG. 13 is a section view taken along line 13-13 of FIG. 12.

FIGS. 12 and 13 illustrate the rotator body 22 in further detail. The rotator body 22 is removeably and rotateably received by the rotator housing 14 and includes a main body 78, a secondary body 82 extending radially outwardly from the main body 78, and a central recess 86 extending axially through the rotator body 22 and shaped to receive the valve stem 26.

The main body 78 of the rotator body 22 is substantially cylindrical and defines the central recess 86. The main body 78 includes a first outer diameter 88 and a second outer diameter 90. The first outer diameter 88 is sized to fit within the innermost diameter of the bottom wall 42 of the rotator housing 14, and extends a first axial distance. The second outer diameter 90 is sized to fit within an inner diameter 36 of the spring washer 34, and extends a second axial distance. In the illustrated construction, the combined first and second distances substantially define the height of the main body 78.

The secondary body 82 extends radially outwardly from the main body 78 and defines a third outer diameter 94 that fits within the outer wall 46 while allowing sufficient clearance to allow relative rotation between the rotator housing 14 and the rotator body 22. The secondary body 82 also defines an annular recess 98 shaped to receive the garter spring 30, an angled lead-in surface 102 that engages the retention members 70 during assembly of the rotator assembly 10, and a retention surface 106 that engages the retention members 70 during disassembly of the rotator assembly. In the illustrated embodiment, the secondary body 82 includes a substantially flat upper surface 110, however, in alternate constructions; the upper surface 110 may be contoured to provide additional strength or perform other functions, as necessary. In still other constructions, the flat upper surface 110 may itself define the retention surface 106.

The annular recess 98 is defined by the secondary body 82 and is shaped to receive the garter spring 30 (described below). In the illustrated construction, the annular recess 98 opens axially toward the main body 78, is defined by a bottom surface 114, and includes a substantially semi-circular cross-section. Alternate cross-sections may be utilized to facilitate the outer contour of different types of garter springs 30. In some constructions, the annular recess 98 may define a plurality of ridges or ribs (not shown) that engage the garter spring 30 and facilitate rotation of the rotator body 22 relative to the rotator housing 14. In still other constructions, the annular recess 98 may be lined with a deformable material (e.g. rubber), also to facilitate rotation of the rotator body 22 with respect to the rotator housing 14.

The lead-in surface 102 defines a chamfer between the third outer diameter 94 and the bottom surface 114 of the rotator body 22. When the rotator body 22 is inserted into the housing 14, the lead-in surface 102 engages the retention members 70 and urges the retention members 70 radially outwardly. In the illustrated embodiment, the lead-in surface 102 extends completely around the third outer diameter 94. In alternate embodiments, the rotator body 22 may include a plurality of radially spaced apart lead-in surfaces 102, each positioned for alignment with a respective one of the retention members 70 during assembly. In still other embodiments, there may be no discernable chamfer or radius between the bottom surface 114 and the third outer diameter 94, in which case the bottom surface 114 itself defines the lead-in surface.

In the illustrated construction, the retention surface 106 is formed as a radius between the third outer diameter 94 and the upper surface 110 of the rotator body 22, and facilitates retention of the rotator body 22 with respect to the rotator housing 14. The retention surface 106 extends completely around the third outer diameter 94. In alternate embodiments, the corner defined by the junction of the upper surface 110 and third outer diameter 94 may not be radiused, in which case the upper surface 110 will itself defined the retention surface 106. In yet another embodiment, the retention surface 106 may be in the form of a chamfer between the upper surface 110 and the third outer diameter 94, and may bias the retention members 70 radially outwardly during removal of the body 22 from the housing 14.

The central recess 86 is substantially concentric with the axis 28 and extends axially through the rotator body 22. The central recess 86 includes a first portion 118 and a second portion 122. The first portion 118 extends generally from the upper surface 110 a first distance into the rotator body 22 at a first wall angle. The second portion 122 generally extends from the first portion 118 a second distance into the rotator body 22 at a second, steeper wall angle. The second portion 122 defines a frusto-conical surface 123 configured to receive and capture a set of tapered valve collets 126 (see FIG. 5). In alternate embodiments, the central recess 86 may include additional portions each including a different wall angle, or may be formed from a single portion having a single wall angle.

In the illustrated embodiment, the rotator body 22 is generally formed from a single piece of metallic material (e.g., steel) and may be heat treated and/or hardened as necessary to improve durability. The rotator body 22 may be forged, stamped, cast, machined, formed of powdered metal, or any combination of these to produce the required shape.

Referring again to FIGS. 6-9, the rotator housing 14 receives the spring washer 34 which engages the inner wall 51 of the rotator housing 14. The spring washer 34 is slightly frusto-conical in profile, includes an annular depression 130 that receives the garter spring 34, and defines an inner diameter 36. The spring washer 34 may be formed from any suitable deformable and elastic material (e.g., spring steel). During operation the spring washer 34 deflects into a substantially flat, annular configuration upon application of an axial compressive force between the housing 14 and the body 22.

In the illustrated construction the annular depression 130 is a smooth, concave groove extending completely around the spring washer 34 and shaped to receive the garter spring 30. In alternate constructions, the annular depression 130 may include a plurality of ridges or ribs, or may be lined with a deformable material (e.g., rubber) to assist the garter spring 30 in rotating the rotator body 22 with respect to the rotator housing 14.

The annular recess 98 receives the garter spring 30, which in turn engages the spring washer 34. Although illustrated schematically in the drawings as an annular ring, as understood by those skilled in the art, the garter spring 30 is a relatively tightly wound helical coil spring having a length that substantially corresponds to the circumference of the annular recess 98. The garter spring 30 is substantially circular in cross-section and its coils deflect when subjected to an axial load. In some constructions, the garter spring 30 may be filled or coated with a deformable material (e.g., rubber) to provide additional vertical support under load and/or to assist in returning the garter spring 30 to its initial position.

The valve rotator assembly 10 can be assembled as a unit and transported to an engine manufacturing or rebuilding facility for installation. During assembly, the spring washer 34 is positioned in the rotator housing 14 against the inner surface 51. The garter spring 30 is positioned in the annular recess 98 and the rotator body 22 is axially inserted into the rotator housing 14. During such insertion the retaining tips 74 of the retention members 70 contact the lead-in surface 102 and deflect radially outwardly until the retaining tips 74 snap over the retention surface 106. When the rotator body 22 is completely received by the rotator housing 14, the garter spring 30 and spring washer 34 are captured therebetween. Once assembled, the completed rotator assembly 10 may be installed in a valve train of an engine, or shipped as a unit to a manufacturing or rebuilding facility.

To install the completed valve rotator assembly 10 in the valve train of an engine, the assembly 10 is positioned so the valve seat(s) 50*a*, 50*b* of the rotator housing 14 engage the end(s) of the valve spring(s) 18*a*, 18*b*. The valve stem 26 is inserted through a valve guide in the cylinder head (not shown), and into the central recess 86. The valve springs 18*a*, 18*b* are compressed to expose the end of the valve stem 26 such that the collets 126 can be installed thereabout. The valve springs 18*a*, 18*b* are released and the collets 126 move into engagement with the angled surface 123 of the rotator body 22, which biases the collets 126 into engagement with the end of the valve stem 26 to secure the valve 12 to the valve rotator 10.

In operation, a valve train component operates to open the valve 12 by moving the valve stem 26 axially against the biasing force of the valve spring(s) 18*a*, 18*b*. The valve stem 26 in turn moves the rotator body 22 due to engagement between the valve collets 126 and the frusto-conical surface 123. The garter spring 30 and spring washer 34 are thereby compressed between the rotator body 22 and the rotator housing 14. When the valve train component operates to close the valve, at least some of the compressive forces applied to the garter spring 30 and spring washer 34 are reduced, thereby allowing the garter spring 30 and spring washer 34 to at least partially return toward a relaxed configuration. This cycling of compression and relaxation of the garter spring 30 and spring washer 34 rotates the rotator body 22 and valve 12 relative to the rotator housing 14 in a known manner.

The resilient retention members 70 allow the valve rotator assembly 10 to be disassembled and rebuilt without damaging or permanently (e.g., plastically) deforming the body 22 or the housing 14. To disassemble the valve rotator 10, the rotator body 22 is pressed or otherwise withdrawn axially from the rotator housing 14, causing the retention surface 106 to engage the retaining tips 74, and urging the retention members 70 radially outwardly. Once the rotator body 22 has been removed from the housing 14, the retention members 70 elastically return to their original positions. The various parts of the assembly 10 may then be inspected and/or replaced, if necessary. The garter spring 30 and/or the spring washer 34 are the components most likely to require replacement. The various parts may then be re-assembled as described above and returned to service.

The resilience of the retention members 70 provides a rotator housing structure 14 that affords a snap fit between the rotator body 22 and the rotator housing 14 even when the housing 14 material is significantly hardened. The radiused geometry of the recesses 62 functions to distribute stresses that might otherwise lead to fractures when the retention members 70 deflect during assembly and disassembly of the valve rotator assembly 10.

Although the foregoing disclosure has been directed generally to valve rotator assemblies including a garter spring and spring washer rotary advance mechanism, it should be appreciated that the teachings herein may also be incorporated into other valve rotators having other rotary advance mechanisms, such as valve rotators that utilizes various combinations of springs, ball bearings, wedges, and other known structures that provide relative rotation between the rotator body 22 and the rotator housing 14 during actuation of the valve 12.

What is claimed is:

1. A valve rotator assembly for rotating an internal combustion engine valve about an axis in response to reciprocating movement of the valve, the valve rotator assembly comprising:

a body for coupling to a portion of the valve, the body including a retention surface;

a housing that removably and rotatably receives the body, the housing including a bottom wall, and a plurality of resilient members that engage the retention surface to removably couple the body to the housing;

a rotary advance mechanism engaging the body and the housing to rotate the body relative to the housing; and wherein the housing includes an outer wall extending axially away from the bottom wall and at least partially surrounding the body when the body is received by the housing, and wherein the resilient members include portions extending radially inwardly for engagement with the retention surface.

2. The valve rotator assembly of claim 1, wherein the outer wall defines a plurality of recesses, and wherein the resilient members are defined between adjacent ones of the recesses.

3. The valve rotator assembly of claim 2, wherein the recesses are substantially U-shaped and open axially away from the bottom wall.

4. The valve rotator assembly of claim 1, wherein the portions include retaining tips that extend axially beyond an end surface of the outer wall, and wherein the retaining tips engage the retention surface.

5. The valve rotator assembly of claim 1, wherein the body includes a lead in surface axially spaced from the retention surface, and wherein the lead in surface engages the plurality of resilient members and biases the plurality of resilient members radially outwardly as the body is inserted into the housing.

6. The valve rotator assembly of claim 5, wherein the retention surface engages the plurality of resilient members and biases the plurality of resilient members radially outwardly as the body is removed from the housing.

7. The valve rotator assembly of claim 1, wherein the housing is formed of a low carbon or mild carbon steel.

8. The valve rotator assembly of claim 7, wherein the housing has a surface hardness of at least about 402 HK.

9. The valve rotator assembly of claim 7, wherein the housing has a surface hardness of at least about 510 HK.

10. A method of assembling a valve rotator for rotating a valve of an internal combustion engine about an axis, the method comprising:

providing a housing including a plurality of resilient members;

providing a body for coupling with the valve and including a retention surface;

positioning components of a rotary advance mechanism between the housing and the body;

positioning the body for insertion into the housing;

axially inserting the body into the housing, including engaging the body with the resilient members and thereby urging the resilient members away from a relaxed position;

moving the retention surface axially beyond the resilient members, thereby allowing the resilient members to return to the relaxed position to retain the body within the housing; and wherein the resilient members are formed between adjacent recesses defined by an outer wall of the housing, and wherein urging the resilient members away from the relaxed position includes moving the resilient members radially outwardly relative to the outer wall.

11. The method of claim 10, wherein the housing is formed from low carbon or mild carbon steel, and wherein providing the housing includes hardening the housing to have a surface hardness of at least about 402 HK.

12. The method of claim 11, wherein the housing is formed from low carbon or mild carbon steel, and wherein providing the housing includes hardening the housing to have a surface hardness of at least about 510 HK.

13. The method of claim 10, wherein engaging the body with the resilient members includes engaging a lead-in surface with the resilient members, the lead-in surface defining a chamfer between a bottom surface and an outer diameter of the body.

14. A valve rotator assembly for rotating a valve of an internal combustion engine about an axis, the valve rotator assembly comprising:

a housing formed of low carbon or mild carbon steel and hardened to have a surface hardness in a range of about 510 HK to about 630 HK, the housing having a bottom wall defining at least one spring seat, an outer wall extending axially away from the bottom wall and defining an end surface facing axially away from the bottom wall, and a plurality of axially-extending resilient members formed between recesses defined by the outer wall, each resilient member including a radially inwardly-extending retention tip that extends axially beyond the end surface of the outer wall;

a body removably and rotatably received within the housing, the body including a substantially cylindrical main portion defining a recess for receiving a portion of the valve, and a substantially annular secondary portion including a bottom surface, a retention surface, an outer diameter, and a lead-in surface formed between the bottom surface and the outer diameter, the lead-in surface urging the resilient members radially outwardly during insertion of the body into the housing, and the retention surface engaging the retention tips of the plurality of resilient members when the body is fully received by the housing to removably retain the body within the housing; and a rotary advance mechanism positioned between the housing and the body to rotate the body relative to the housing.

* * * * *